US007506590B2

(12) United States Patent
Moser et al.

(10) Patent No.: US 7,506,590 B2
(45) Date of Patent: Mar. 24, 2009

(54) JUNCTION BETWEEN RAILWAY VEHICLES WITH ANTI-CLIMBING PROTECTIVE DEVICES

(75) Inventors: Gerhard Moser, Perchtoldsdorf (AT); Clemens Eger, Vienna (AT); Christian Flegel, Vienna (AT); Christoph Schmidt, Vienna (AT)

(73) Assignee: Siemens Transportation Systems GmbH & Co KG, Wien (AT)

( * ) Notice: Subject to any disclaimer, the term of this patent is extended or adjusted under 35 U.S.C. 154(b) by 260 days.

(21) Appl. No.: 10/595,597

(22) PCT Filed: Oct. 8, 2004

(86) PCT No.: PCT/AT2004/000342

§ 371 (c)(1),
(2), (4) Date: Jan. 16, 2007

(87) PCT Pub. No.: WO2005/042329

PCT Pub. Date: May 12, 2005

(65) Prior Publication Data

US 2007/0131135 A1 Jun. 14, 2007

(30) Foreign Application Priority Data

Oct. 31, 2003 (AT) ..... A 1735/2003

(51) Int. Cl.
*B60D 5/00* (2006.01)
*B61D 15/06* (2006.01)
*B61D 17/00* (2006.01)
*B61D 17/14* (2006.01)

(52) U.S. Cl. ..... 105/8.1; 105/392.5; 105/413; 105/15

(58) Field of Classification Search ..... 105/8.1, 105/12, 15, 392.5, 393, 396, 413
See application file for complete search history.

(56) References Cited

U.S. PATENT DOCUMENTS 1,243,932 A * 10/1917 Glaenzer et al. ..... 105/10
1,668,556 A * 5/1928 Glaenzer et al. ..... 105/4.1
3,197,039 A * 7/1965 Herbert ..... 213/74
3,556,312 A * 1/1971 Herbert ..... 213/14

(Continued)

*Primary Examiner*—S. Joseph Morano
*Assistant Examiner*—Jason C Smith
(74) *Attorney, Agent, or Firm*—Sutherland Asbill & Brennan LLP

(57) ABSTRACT

Interconnected train cars (ZUV) with at least two rail vehicles (WA1, WA2) coupled to each other, between which there is a passage (UEB) with at least two gangway bellows (WB1, WB2), which can be connected to each other and which each have several bellows frams (BR1, BR2, BR3, BR4), and the passage (UEB) has additional passage plates (UB1, UB2, UB3, UB4) and a support (ABS) for the passage plates (UB1, UB2, UB3, UB4), with this support being able to move on a sliding plate (GLP) arranged between the rail vehicles (WA1, WA2) above a coupling device (KUP), wherein there is at least one pile-up prevention device (AC1, AC2) at the end regions of the rail vehicles (WA1, WA2) coupled to each other, with the pile-up prevention devices (AC1, AC2) each extending essentially over the entire vehicle width, the bottom edges of the bellows frames (BR1, BR2, BR3, BR4) being arranged over the upper edges of the pile-up prevention devices (AC1, AC2), and the sliding plate (GLP) being arranged under the bottom edge of the pile-up prevention devices (AC1, AC2).

13 Claims, 1 Drawing Sheet

U.S. PATENT DOCUMENTS 3,884,155 A * 5/1975 Maroshick ..... 105/4.4
3,996,859 A * 12/1976 Heisler et al. ..... 105/15
4,252,065 A * 2/1981 Bickel et al. ..... 105/10
4,736,688 A * 4/1988 Ando et al. ..... 105/17
4,798,148 A * 1/1989 Girard ..... 105/17
5,031,544 A * 7/1991 Braemert et al. ..... 105/8.1
5,377,597 A * 1/1995 Richter et al. ..... 105/4.1
6,401,626 B1 * 6/2002 Goebels et al. ..... 105/18
6,685,040 B2 * 2/2004 Heinisch et al. ..... 213/221
6,688,237 B2 * 2/2004 Back et al. ..... 105/392.5
6,712,007 B2 * 3/2004 Yamamoto et al. ..... 105/392.5
2004/0040463 A1 * 3/2004 Yamamoto et al. ..... 105/396
2004/0159263 A1 * 8/2004 Yamamoto et al. ..... 105/392.5
2007/0131135 A1 * 6/2007 Moser et al. ..... 105/8.1
2007/0186802 A1 * 8/2007 Gough ..... 105/392.5
2008/0006173 A1 * 1/2008 Mayer ..... 105/392.5
2008/0250965 A1 * 10/2008 Clark et al. ..... 105/413

* cited by examiner

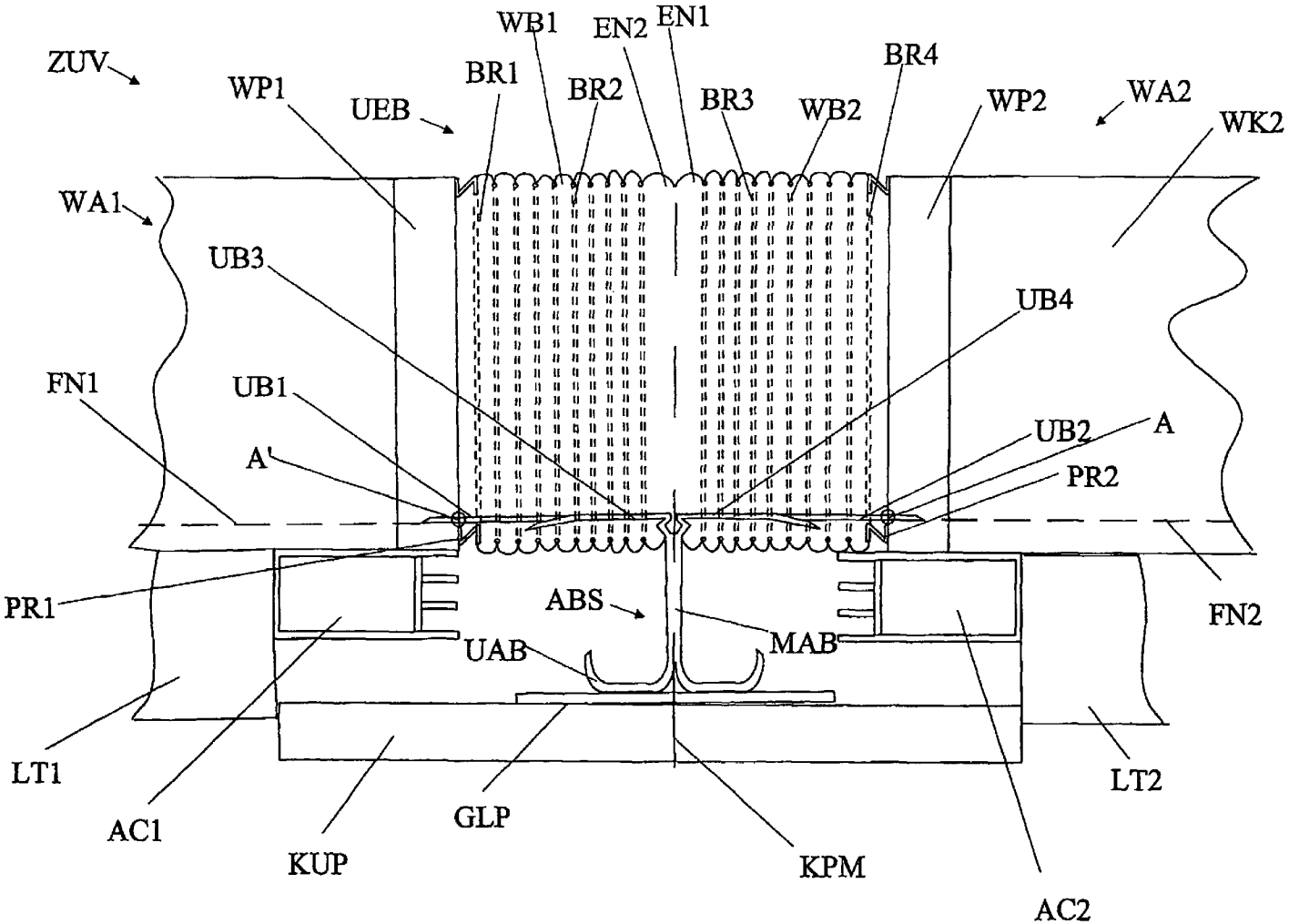
WK2
WA2
WP2
BR4
WB2
BR3
EN1
EN2
BR2
WB1
BR1
UEB
WP1
ZUV
WA1
UB4
UB3
UB1
A'
FN1
A
UB2
PR2
FN2
PR1
LT2
AC2
MAB
ABS
UAB
KPM
GLP
KUP
AC1
LT1

JUNCTION BETWEEN RAILWAY VEHICLES WITH ANTI-CLIMBING PROTECTIVE DEVICES

CROSS-REFERENCE TO RELATED APPLICATIONS

This is the National Stage of International Application No. PCT/AT2004/000342, filed Oct. 8, 2004, which claims benefit of Austrian Patent Application No. A 1735/2003, filed Oct. 31, 2003. These applications are incorporated herein by reference.

The invention relates to interconnected train cars with at least two rail vehicles, which are coupled to each other and between which an all-around closed passage is provided with at least two gangway bellows that can be connected to each other and that each have several bellows frames, and the passage further has passage plates and a support for the passage plates, with this support being able to move on a sliding plate arranged between the railway car by means of a coupling device, wherein at least one pile-up prevention device is provided on the ends of the rail vehicles coupled to each other.

In the case of a rear-end collision accident between two rail vehicles, there is the risk that a car body of a rail vehicle with a height offset will slide over another car and cause severe damage in the passenger compartment. This risk exists not only for the colliding front or end vehicles, but also for the interconnected vehicles in a train. To prevent the risk of pile up, typically pile-up prevention devices are installed. These pile-up prevention devices, so-called "anticlimbers," are installed not only at the ends of the train, but also at the ends of the cars located within the interconnected train cars.

Typically, pile-up prevention devices have several parallel and horizontal ribs, with the pile-up prevention devices of two colliding cars engaging with each other in comb-like fashion. The pile-up prevention devices are conventionally arranged at the longitudinal ends of the solebar of the underframe of a rail vehicle, so that in the case of a collision, force can be introduced into the load-bearing area of the car. Such a pile-up prevention device became known, for example, from U.S. Pat. No. 4,184,434 A.

In the region of the coupling, the pile-up prevention device in rail vehicles is typically interrupted. Furthermore, the pile-up prevention device can optionally have a lining, e.g., made from glass fiber-reinforced plastic, which, in the case of a collision, is crushed before the mutual engagement of the two pile-up prevention devices.

Known pile-up prevention devices almost always compete with the coupling, because when the coupling height and the height of the car bottom are fixed, usually there is little space remaining for a pile-up prevention device under consideration of the coupling movements. This fact is shown, e.g., in the article "Production of rail vehicles" in ZEV+DET Glas. Ann. 123 (1999).

In trains of interconnected cars of the type named above, in which several rail vehicles are coupled to each other and all-around closed passage devices are provided to enable passengers to change from one car to another, when anticlimbers are used, the problem arises, as already mentioned above, that there is only very little installation space available. Due to the small installation space, which is limited first by means of the floor height and second by means of the height of the solebar at whose longitudinal ends the anticlimber is arranged, the arrangement of an interconnected anticlimber over the entire vehicle width with the known all-around closed passage devices is impossible.

A disadvantage of anticlimbers that do not run over the entire vehicle width is primarily that in the case of a collision, the anticlimbers of the colliding vehicles can be displaced laterally relative to each other, which can reduce the effectiveness of the pile-up prevention devices.

One problem of the invention is to devise a passage device or interconnected train cars, in which the above-mentioned disadvantage is eliminated as much as possible.

This problem is solved according to the invention with interconnected train cars of the type named above, such that the pile-up prevention devices each run essentially over the entire vehicle width, the bottom edges of the bellows frames are arranged above the upper edges of the pile-up prevention devices, and the sliding plates, especially including the solid parts of the passage support, are arranged under the bottom edges of the pile-up prevention devices.

The passage is connected to the car body in the region under the bridge plates. In particular, the bottom edge of one end bellows frame of each gangway bellows is connected to the car body via at least one bottom profile arranged under the base region of the passage and above the upper edge of the pile-up prevention devices in front of a car body of one of the railway cars. Here, this bottom profile is shaped so that it is suitable in its size to be able to manage with the available installation space. This objective can be realized in that the bottom profile has a Z-shaped cross section. Also, the top side and the side regions of the passage are connected to the car body with profiles. However, in terms of installation size, no special requirements are placed on the shape of these profiles.

The wear of the support can be reduced and thus its service life can be increased by manufacturing the sections of the support interacting with the sliding plate from steel.

In order not to prevent the engagement of the anticlimbers in the case of a collision, the support can be built from aluminum in its vertical section, which extends in an installed state essentially orthogonal to the plane of the rails and which is set between the pile-up prevention devices. Due to this embodiment, the parts arranged between the anticlimbers are significantly softer than the anticlimbers and thus do not prevent their engagement in the case of a collision.

To provide the necessary space for the block of the all-around closed gangway bellows arranged between the two rail vehicles in the case of a collision, and thus to guarantee a secure engagement of the two anticlimbers, the load-bearing structure of the end of each rail vehicle is set back to the end regions coupled to each other in the longitudinal direction of the vehicle, wherein profiles made from a more deformable material than the load-bearing structure of the end wall are mounted in front of the load-bearing structure. Thus, the profiles placed in front of the load-bearing structure can collapse in the case of a crash, and the necessary space for the block length of the passage can be provided. Here, the block length is understood to be the length of the compacted gangway bellows.

The invention, including the additional advantages, is explained in more detail below with reference to a few non-restricting embodiments, which are shown in the drawings. In this drawing, the single FIGURE shows a schematic view of a cross section along the longitudinal axis of the interconnected train cars according to the invention.

According to the shown embodiment, the interconnected train cars ZUV according to the invention have at least two vehicles WA1, WA2 coupled to each other via a coupling KUP. Each of the two vehicles WA1, WA2 has at one longitudinal end a pile-up prevention device AC1, AC2, which runs essentially over the entire vehicle width and which is preferably produced from steel. Here, the pile-up prevention device AC1, AC2 of each car WA1, WA2 can be connected to the underframe via the longitudinal ends of solebars LT1, LT2 of the underframe. In the embodiment shown here, forces are introduced from the pile-up prevention devices AC1, AC2 via the end surfaces of the solebars LT1, LT2 into the underframe, with force being introduced into the underframe not exclusively via the ends of the solebars, but also in the middle via solebars, which are connected to the main transom and which also include the interface to the coupling.

Between the rail vehicles WA1, WA2, there is a passage UEB, which has an all-around closed gangway bellows consisting of at least two parts WB1, WB2; namely a first gangway bellows WB1 allocated to the car WA1 on the left in the drawing and a second gangway bellows WB2 allocated to the car WA2 on the right in the drawing. The gangway bellows WB1, WB2 can be connected to each other at their ends EN1, EN1 allocated to each other. Here, each bellows WB1, WB2 can have, for example, an end frame not shown here, wherein these frames can be screwed to each other or connected via another coupling mechanism. The gangway bellows WB1, WB2 each have parallel bellows frames BR1, BR2, BR3, BR4, which are preferably produced from aluminum. In the drawing, these bellows frames BR1, BR2, BR3, BR4 are indicated by dotted lines. Here a bellows frame BR1, BR2, BR3, BR4 is located between two undulations of the gangway bellows WB1, WB2. The function of the bellows frames BR1, BR2, BR3, BR4 is to maintain the structure of the gangway bellows and to interconnect the undulations of the gangway bellows. The bellows frames BR1, BR2, BR3, BR4 are arranged so that the bottom edges of the bellows frames BR1, BR2, BR3, BR4 come to lie above the upper edges of the pile-up prevention devices AC1, AC2. This configuration prevents the bellows frames BR1, BR2, BR3, BR4 from obstructing the engagement of the pile-up prevention devices AC1, AC2 if there is a collision.

To enable the arrangement of the bellows frames BR1, BR2, BR3, BR4 above the pile-up prevention devices AC1, AC2, the bottom edge of a car body-side, end bellows frame BR1, BR4 of each gangway bellows WB1, WB2 is connected to the car bodies WK1, WK2 via a profile PR1, PR2 arranged under the base region of the passage UEB and above the upper edge of the pile-up prevention devices AC1, AC2 in front of a car body WK1, WK2 of one of the rail vehicles WA1, WA2. The use of narrow profiles PR1, PR2 as screw-on frames in the horizontal base region of the passage enables a simple assembly of the passage UEB above the upper edge of the anticlimbers AC1, AC2. The profiles PR1, PR2 can also be part of a frame mounted on the car bodies WK1 or WK2.

Furthermore, in the passage UEB there are passage plates, so-called bridge plates UB1, UB2, UB3, UB4, wherein two passage plates designated as UB1, UB2, in the following designated as "side passage plates" UB1, UB2, are mounted on a profile WP1, WP2 of the allocated car body WK1, WK2 so that they can each rotate about an axis A, A' parallel to the plane of the rails and normal to the vehicle longitudinal direction, with the passage plates UB1, UB2, UB3, UB4 essentially lying at the level of the floor upper edges FN1, FN2.

Furthermore, the load-bearing structure of the end wall of each railway car WA1, WA2 can be set back at the end regions coupled to each other in the vehicle longitudinal direction. In the installation space opened up by setting this structure back, profiles WP1, WP2 made from a more deformable material than the load-bearing structure of the end wall are installed on both sides of an opening into the car bodies WK1, WK2, through which a passenger can move from one vehicle WA1, WA2 to the other by means of the passage UEB. The side passage plates UB1, UB2 can be mounted in the way described above onto these profiles WP1, WP2, as is visible from the drawing.

Through the arrangement of profiles WP1, WP2 made from a more deformable material, for example, aluminum, than the load-bearing structure of the end wall, which can be produced from steel, in the case of a crash, the softer profiles WP1, WP2 deform, which creates the necessary space for the block length of the passage UEB.

A support ABS for a middle passage plate or middle passage plates UB3, UB4 are arranged above the coupling middle KPM of the two rail vehicles WA1, WA2. The support ABS can be integrated with the middle passage plate at its upper region. The side passage plates UB1, UB2 arranged on the car bodies WK1, WK2 lie on this passage plate or passage plates UB3, UB4. The free ends of the middle passage plate or the passage plates UB3, UB4 can be beveled and lie under the side passage plates UB1, UB2. Thus, the side passage plates UB1, UB2 are supported on their free ends on the middle passage plates UB3, UB4. By beveling the free ends of the middle passage plates UB3, UB4, a ramp surface for the side passage plates UB1, UB2 is created, which can compensate for displacements of the two cars WA1, WA2 relative to each other in the vertical and horizontal directions.

The support ABS can move on a sliding plate GLP arranged above the coupling device KUP. The solid section UAB of the support ABS interacting with the sliding plate GLP can be produced from steel in order to improve the wear properties, just like the sliding plate support on which the actual plastic sliding plate is mounted. The sliding plate GLP and the bottom section UAB of the support ABS is arranged according to the invention under the bottom edge of the pile-up prevention devices AC1, AC2. The arrangement of the sliding plate GLP and also the base UAB of the support ABS interacting with the sliding plate are arranged under the pile-up prevention devices AC1, AC2, which can prevent the sliding plate GLP or the base UAB of the support from interfering with the engagement of the pile-up prevention devices AC1, AC2 in the event of a collision.

Furthermore, the support ABS can be made from aluminum in a vertical section MAB, which runs in an installed state essentially normal to the plane of the rails and which is set between the anticlimbers AC1, AC2. This embodiment guarantees that the pile-up prevention devices AC1, AC2 penetrate or deform the vertical middle section MAB made from aluminum, and thus can engage each other in the event of a collision.

In conclusion, it should be mentioned that in the present document, the term rail vehicle is understood to be not only a pulled car, but also a locomotive, although the preferred embodiment of the invention does not present this configuration.

The invention claimed is:

1. A railway vehicle junction system comprising:

a coupling device which couples a first railway vehicle and a second railway vehicle;

a passage between the first railway vehicle and the second railway vehicle, the passageway including (i) at least two gangway bellows each of which have a plurality of bellows frames which have bottom edges, (ii) at least one passage plate, and (iii) a passage plate support which supports the at least one passage plate;

a sliding plate on which the passage plate support is adapted to move, the sliding plate being disposed between the first railway vehicle and the second railway vehicle above the coupling device;

a first anti-climbing protective device having an upper edge and a lower edge, wherein the first anti-climbing protective device extends essentially over the entire width of the first railway vehicle and is located on an end region of the first railway vehicle; and a second anti-climbing protective device having an upper edge and a lower edge, wherein the second anti-climbing protective device extends essentially over the entire width of the second railway vehicle and is located on an end region of the second railway vehicle;

wherein the bottom edges of the bellows frames are positioned above the upper edges of the first and second anti-climbing protective devices and the sliding plate is positioned under the lower edges of the first and second anti-climbing protective devices.

2. The system of claim 1, wherein the first anti-climbing protective device comprises a plurality of parallel and horizontal ribs and wherein the second anti-climbing protective device comprises a plurality of parallel and horizontal ribs.

3. The system of claim 1, wherein the first railway vehicle has a body which comprises a first deformable portion attached to the passage and the second railway vehicle has a body which comprises a second deformable portion attached to the passage such that during a rear-end collision or the front-end collision, compressive forces cause the passage to at least partially displace and deform the first deformable portion and the second deformable portion.

4. The system of claim 1, wherein the passage plate support comprises a first support material which is softer than the material of either the first or second anti-climbing protective devices, such that during a rear-end or front-end collision the first and second anti-climbing protective devices deform or penetrate the passage plate support to engage the first and second anti-climbing protective devices to prevent the first railway vehicle from sliding over or under the second railway vehicle.

5. The system of claim 4, wherein the passage plate support further comprises a solid section positioned on the sliding plate and on a plane below the first and second anti-climbing protective devices, wherein the solid section comprises a second support material which is harder than the first support material.

6. The system of claim 5, wherein the first support material comprises steel.

7. The system of claim 5, wherein the first attaching means comprises a bracket having a Z-shaped cross-section attached to the bottom of the first gangway bellow and the bottom of the body of the first railway vehicle and second attaching means comprises a bracket having a Z-shaped cross-section attached to the bottom of the second gangway bellow and the bottom of the body of the second railway vehicle.

8. The system of claim 4, wherein the material of the first or second anti-climbing protective devices material comprises steel.

9. The system of claim 4, wherein the first support material comprises aluminum.

10. The system of claim 1, wherein the at least one passage plate comprises a first side passage plate attached to the first railway vehicle, a second side passage plate attached to the second railway vehicle, and a middle passage plate adjacent to both the first side passage plate and the second passage plate.

11. The system of claim 1, wherein the passage comprises a first gangway bellow attached to the first railway vehicle by a first attaching means; a second gangway bellow attached to the second railway vehicle by a second attaching means, wherein the first gangway bellow and the second gangway bellow form a continuous, closed passage.

12. The system of claim 1, where the first railway vehicle comprises a pulled car.

13. The system of claim 1, where the first railway vehicle comprises a locomotive.

* * * * *